United States Patent [19]

Murai

[11] Patent Number: 5,012,529

[45] Date of Patent: May 7, 1991

[54] BASEBALL GLOVE AND INTERIOR CORE COVERING THEREOF

[76] Inventor: Hideaki Murai, 7-16 Daikoku 3-chome, Naniwa-ku, Osaka, Japan

[21] Appl. No.: 440,521

[22] Filed: Nov. 22, 1989

[30] Foreign Application Priority Data

May 17, 1989 [JP] Japan ..... 1-56934[U]

[51] Int. Cl.[5] ..... A41D 13/10

[52] U.S. Cl. ..... 2/18; 2/19

[58] Field of Search ..... 2/19, 18, 163, 169, 2/161 A

[56] References Cited

U.S. PATENT DOCUMENTS

| | | | |
|---|---|---|---|
| 1,822,010 | 9/1931 | Cecil | 2/169 |
| 2,231,204 | 2/1941 | Turner | 2/163 |
| 2,336,724 | 12/1943 | Dubow | 2/169 |
| 3,528,107 | 9/1970 | Rosenbaum | 2/19 |
| 3,918,096 | 11/1975 | Lim | 2/161 A |
| 4,453,275 | 6/1984 | Kawada | 2/169 |
| 4,477,927 | 10/1984 | Tsubota et al. | 2/19 |

FOREIGN PATENT DOCUMENTS 1-23510 7/1989 Japan .

*Primary Examiner*—William A. Cuchlinski, Jr.
*Assistant Examiner*—Daniel G. DePumpo
*Attorney, Agent, or Firm*—Armstrong, Nikaido, Marmelstein, Kubovcik & Murray

[57] ABSTRACT

The invention relates to a baseball glove and an interior core covering thereof. Each fingerstall of each back member of the interior core covering and exterior covering constituting the baseball glove is formed by one back piece and two side pieces arranged on both sides thereof. The back piece is dimensioned longer than the side pieces; thus, it is easy to insert the hand and the fingerstall is curved concavely toward a ball catching face.

12 Claims, 6 Drawing Sheets

FIG.7
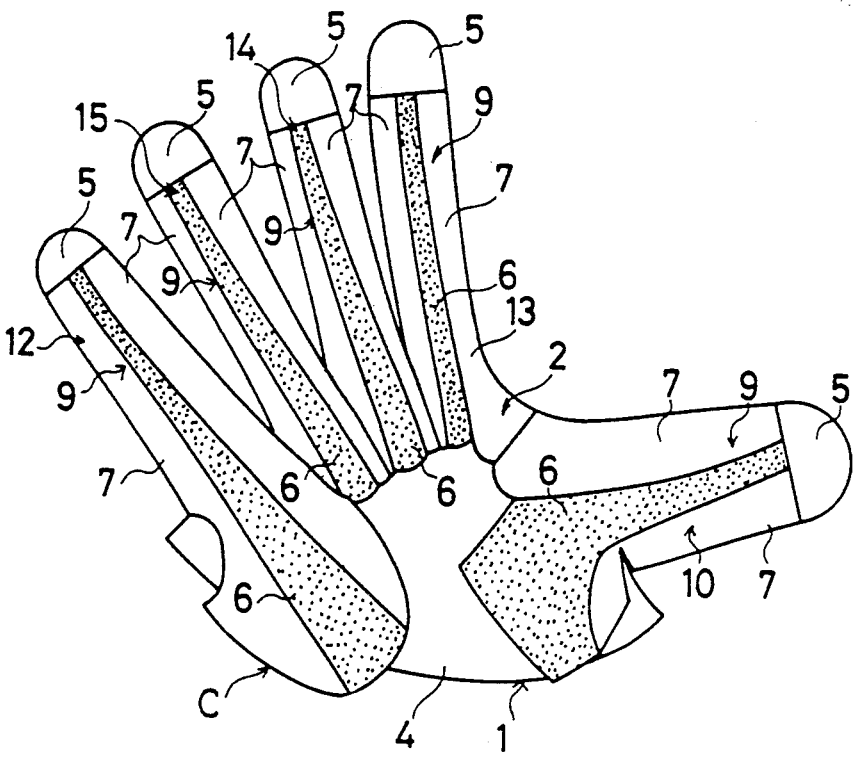
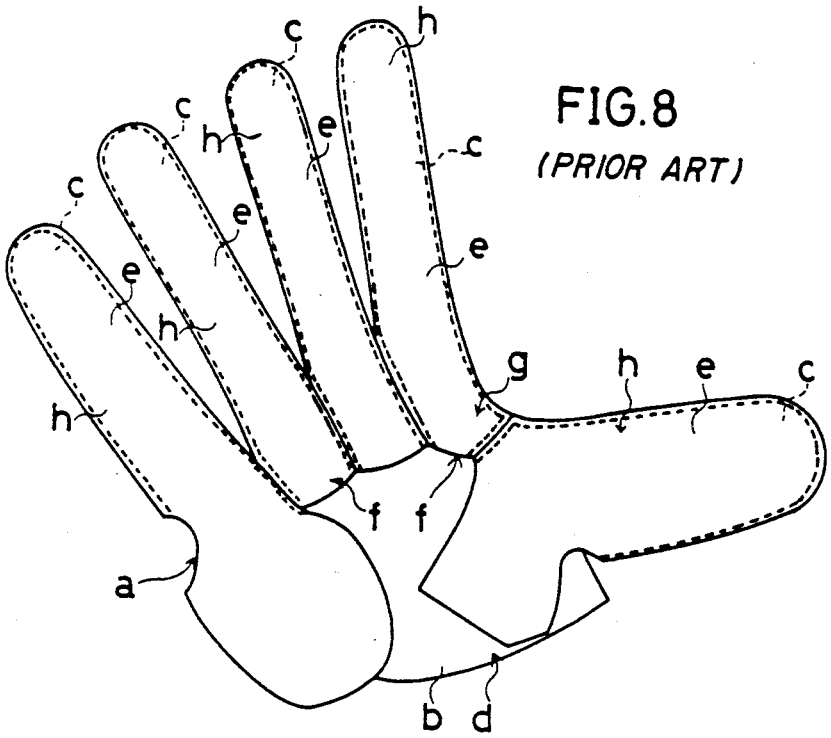
FIG.8
(PRIOR ART)

BASEBALL GLOVE AND INTERIOR CORE COVERING THEREOF

BACKGROUND OF THE INVENTION

This invention relates to a baseball glove and more particularly, to an interior core covering of the baseball glove whose fingerstalls are curved concavely toward a ball catching face.

Generally, the baseball glove is formed by inserting an interior core covering in an exterior covering. As shown in FIG. 8, an interior core covering a of a conventional baseball glove comprises a core covering surface member d consisting of a palm piece b adapted for contact with the palm and five finger pieces c adapted for contact with the corresponding surfaces of the thumb and fingers which extend from the upper edge of the palm piece b, and a back member g consisting of back pieces e larger in width than the finger pieces which are arranged so as to cover from the tips of the finger pieces c to the back of a central portion of the palm piece b of the core covering surface member d. The side edges of the back pieces e are seamed with the side edges of the finger pieces c of the core covering surface member d, and the side edges of some back pieces e are seamed together, whereby a covering body f adapted for insertion of the hand is formed by the core covering surface member d on the surface side and the back member g.

The conventional baseball glove is assembled by inserting the foregoing interior core covering a of the conventional baseball glove in an exterior covering having a covering body structure adapted to accommodate the interior core covering which consists, for each finger, of two back pieces arranged so as to cover the finger back and up to a central portion of the palm back and seamed together to form one seam line along the center line of the finger back.

In the interior core covering a of the conventional baseball glove, however, since a fingerstall h for each finger is formed by the core covering surface member d and one back piece e, the inner space of the fingerstall h is small, the finger is difficult to insert, and the finger inserted suffers a sense of oppression. Further, since the interior core covering a as a whole is flat and hardly curved, the baseball glove assembled by inserting the interior core covering a in the exterior covering is not curved concavely toward the ball catching face; accordingly, force must be applied to curve the glove fingerstalls concavely toward the ball catching face in use, but it is difficult to catch the ball because of slight curvature.

Further, since the exterior covering of the conventional baseball glove has similar drawbacks and includes two back pieces for each finger which are seamed together so as to result in one seam line along the center line of the finger back, the finger back touches the seam line of the exterior covering via the back member of the interior core covering when the glove is put on, resulting in a feeling of physical disorder, this influencing a ball catching action.

SUMMARY OF THE INVENTION

It is the object of the present invention to provide an interior core covering of a baseball glove which facilitates insertion of each finger and imposes no sense of oppression on each finger inserted and whose fingerstalls are curved concavely toward a ball catching face, and to provide a baseball glove with glove fingerstalls curved concavely toward the ball catching face which is configured so that each finger back does not touch the seam lines of an exterior covering when the glove is put on.

To achieve the foregoing object, the present invention provides an interior core covering of a baseball glove formed by inserting the interior core covering in an exterior covering, which comprises a core covering surface member consisting of a palm piece adapted for contact with the palm and five finger pieces adapted for contact with the corresponding surfaces of the thumb and fingers which extend from the upper edge of the palm piece, and a back member consisting of back pieces smaller in width than the finger pieces which are arranged so as to cover from tip portions of the corresponding finger pieces to the back of a central portion of the palm piece of the core covering surface member and side pieces substantially equal in length to the back pieces which are arranged on both sides of the corresponding back pieces, wherein one side edge of the side pieces is brought in contact with either side edges of the corresponding back pieces and seamed therewith, and the other peripheral edges of the side pieces are seamed with the peripheral edges of the finger pieces and the palm piece of the core covering surface member, whereby a covering body adapted for insertion of the hand is formed by the core covering surface member on the surface side and the back member.

Because of the effects as will be described later, it is preferable that the back piece and the side pieces be arranged so as to cover the finger piece from root to tip are dimensioned such that the back piece is longer.

It is preferable that the width of each back piece increases progressively from tip to root like an unfolded fan, and both side edges of each back piece are brought in face-to-face contact with the one side edges of the corresponding side pieces and seamed therewith to form two ribs on the surface of the back member in the longitudinal direction of the finger.

Because of the effects as will be described later, it is preferable that finger root portions of the back pieces for the fingers except the thumb are connected integrally together on the back of the palm piece.

In addition, to achieve the foregoing object, the present invention provides a baseball glove formed by: an interior core covering comprising a core covering surface member consisting of a palm piece adapted for contact with the palm and five finger pieces adapted for contact with the corresponding surfaces of the thumb and fingers which extend from the upper edge of the palm piece, and a back member consisting of back pieces smaller in width than the finger pieces which are arranged so as to cover from tip portions of the corresponding finger pieces to the back of a central portion of the palm piece of the core covering surface member and side pieces substantially equal in length to the back pieces which are arranged on both sides of the corresponding back pieces, wherein one side edge of the side pieces is brought in contact with either side edge of the corresponding back pieces and seamed therewith, and the other peripheral edges of the side pieces are seamed with the peripheral edges of the finger pieces and the palm piece of the core covering surface member, whereby a covering body adapted for insertion of the hand is formed by the core covering surface member on the surface side and the back member; and an exterior covering having a covering body structure adapted to accommodate the interior core covering and including, for each finger, a back piece smaller in width than the finger back which is arranged so as to cover the finger back and up to a central portion of the palm back and side pieces arranged on both sides of the back piece so as to result in two parallel seam lines on the finger back.

It is preferable that the back piece and the side pieces of the interior core covering for covering the finger piece from root to tip are dimensioned such that the back piece is longer, and the back piece and the side pieces of the exterior covering for covering the finger back and up to a central portion of the palm back are dimensioned such that the back piece is longer.

As will be appreciated, according to the interior core covering of the baseball glove of the present invention, each fingerstall is formed by the back piece and the side pieces arranged on both sides thereof of the core covering surface member and those of the back member, leaving a large space inside the fingerstall; thus, the baseball glove assembled by inserting the interior core covering in the exterior covering facilitates insertion of each finger and imposes no sense of oppression on each finger in use.

Further, where the back piece and the side pieces arranged so as to cover the finger piece from root to tip are dimensioned such that the back piece is longer, each fingerstall of the interior core covering is kept in the state wherein it is curved concavely toward the ball catching face; thus, each fingerstall of the baseball glove is also curved concavely toward the ball catching face; accordingly, the ball can be caught readily and surely not only in an initial stage of use but also after a long period of use.

Furthermore, according to the baseball glove of the present invention, the ball can be caught under the condition that each finger is seated between the corresponding two parallel seam lines on the finger back of the exterior covering via the back piece of the interior core covering.

BRIEF DESCRIPTION OF THE DRAWINGS

FIG. 6(*a*) is a schematic plan view of an interior core covering according to a third embodiment;

FIG. 6(*b*) is a schematic plan view of a modification of the interior core covering according to the third embodiment;

FIG. 7 is a schematic plan view of an interior core covering according to a fourth embodiment; and FIG. 8 is a plan view of a conventional interior core covering.

DESCRIPTION OF THE PREFERRED EMBODIMENTS

Figure 1:
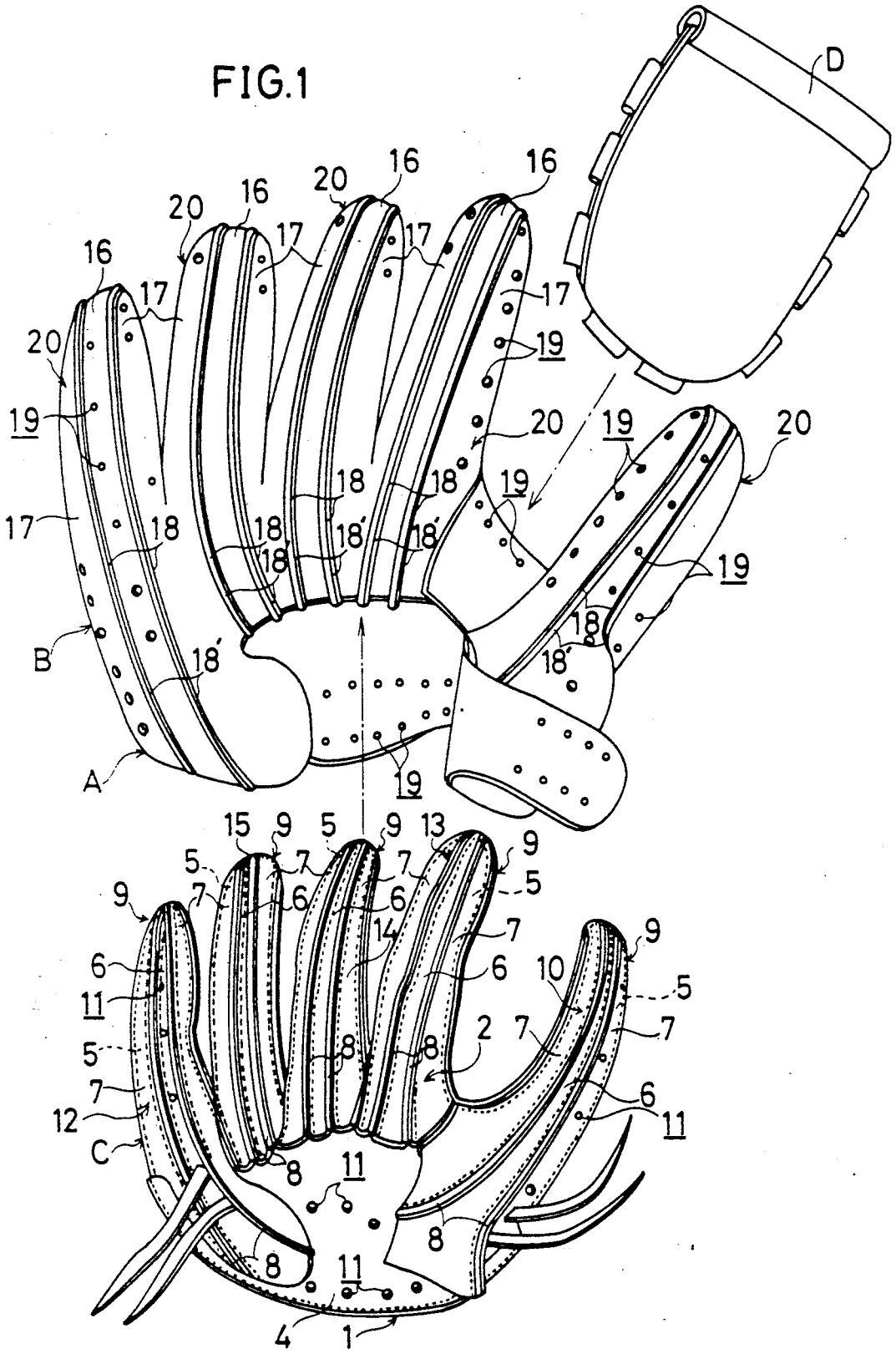
FIG. 1 is an exploded perspective view of a baseball glove according to a first embodiment of the present invention.

The present invention will now be described in greater detail with reference to embodiments shown in the drawings. FIG. 1 is an exploded perspective view of a baseball glove according to a first embodiment of the present invention.

A baseball glove A as shown in FIG. 1 comprises an exterior covering B, an interior core covering C, and a connecting member D, and is assembled by inserting the interior core covering C in the exterior covering B, attaching the connecting member D, and running a strap not shown.

Figure 2:
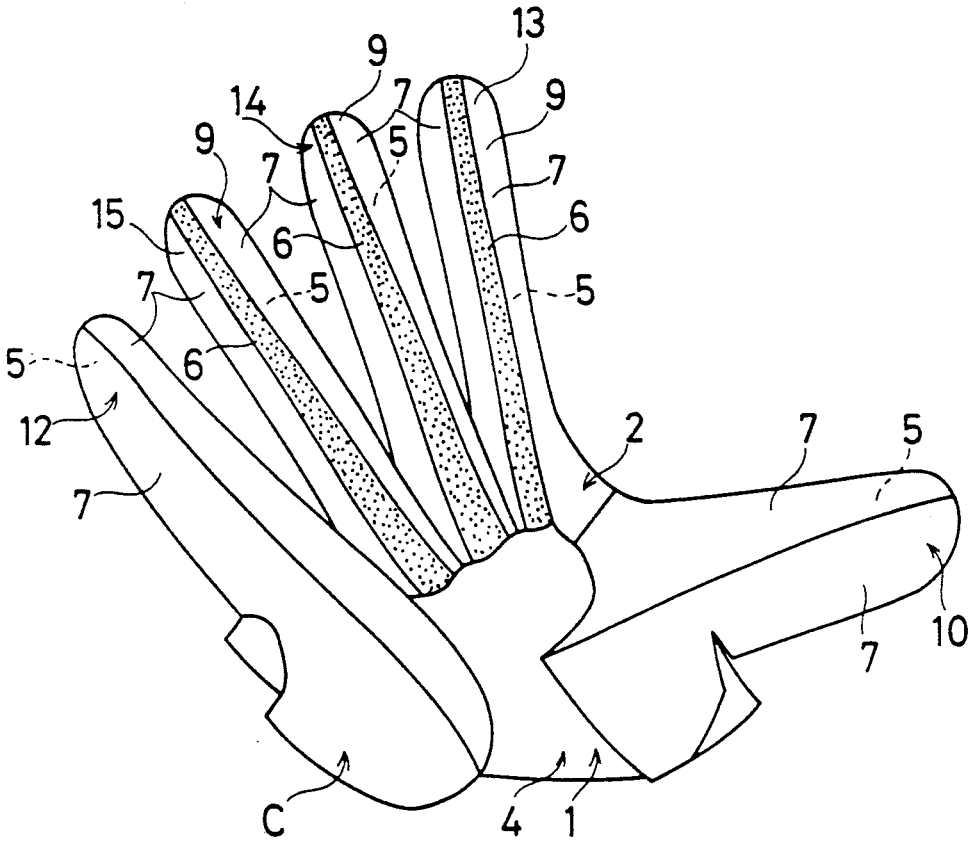
FIG. 2 is a schematic plan view of a modification of an interior core covering according to the first embodiment.
Figure 3:
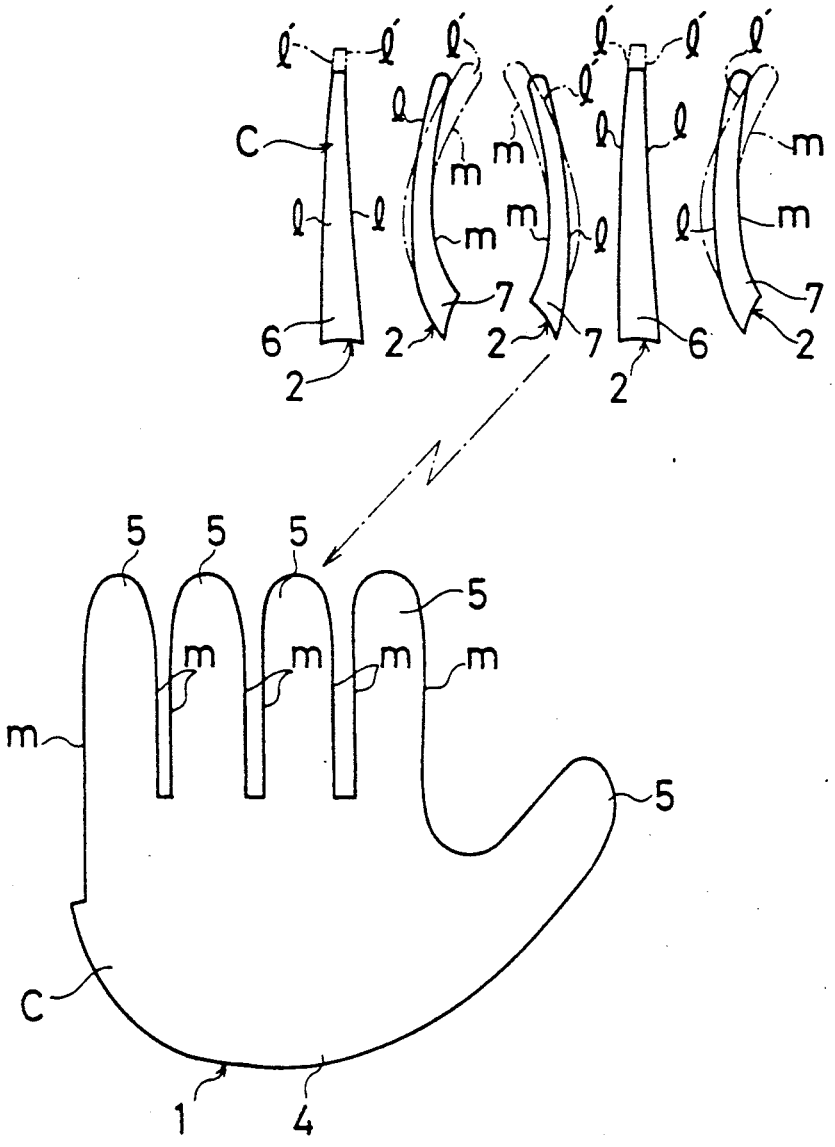
FIG. 3 is a schematic exploded plan view of the interior core covering before assembling.
Figure 4:
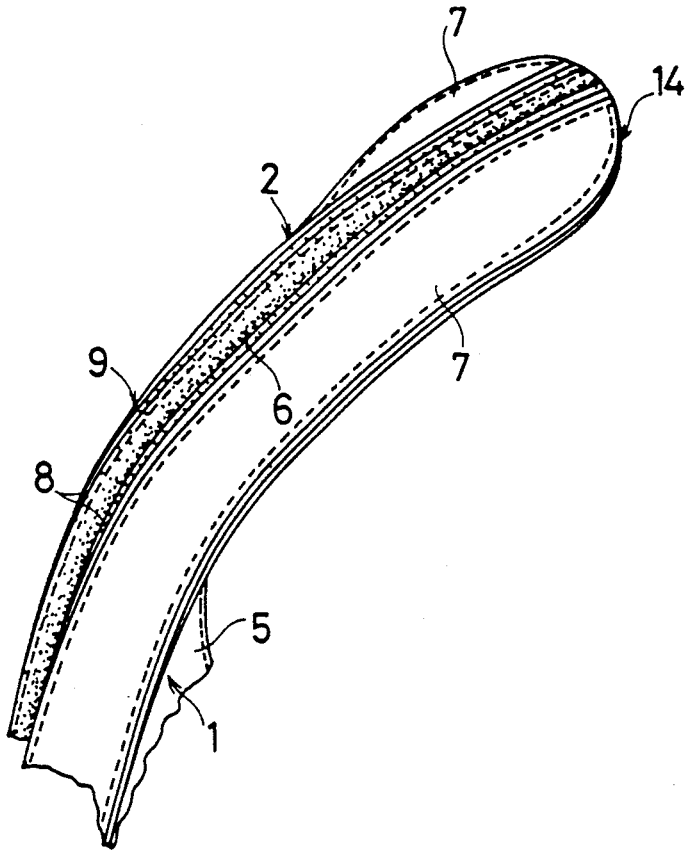
FIG. 4 is a perspective view of a middle fingerstall of the interior core covering.

The interior core covering C will be described which is composed of a core covering surface member 1 and a back member 2. The core covering surface member 1 as shown in FIG. 3 consists of a palm piece 4 adapted for contact with the palm and five finger pieces 5 adapted for contact with the respective surfaces of the thumb and fingers that extend from the upper edge of the palm piece 4. The back member 2 consists of back pieces 6 and side pieces 7 arranged on both sides of each back piece 6, or comprises three kinds of pieces. The back piece 6 as shown in FIG. 2 is arranged so as to cover from a tip portion of the corresponding finger piece 5 to the back of a central portion of the palm piece 4 of the core covering surface member 1, and is dimensioned such that its width is smaller than that of the finger piece 5 and increases progressively from tip to root like an unfolded fan in the illustrated embodiment. The side piece 7 as shown in FIG. 3 is arranged on either side of the corresponding back piece 6, dimensioned such that it covers from a tip portion of the corresponding finger piece 5 to the back of a central portion of the palm piece 4 of the core covering surface member 1, and is arcuately curved so as to bend backward from the back piece 6. Before seaming, as shown in FIG. 3, the length l of both side edges of the back piece 6 is longer than the length m of the side edge of the finger piece 5 of the core covering surface member 1, and the side piece 7 is dimensioned such that the length of its one side edge coming to contact with the back piece 6 is equal to the length l and the length of its other side edge is equal to the length m. At the time of seaming, the side pieces 7 are arranged on both sides of the back piece 6, the back piece 6 is longitudinally extended so as to assume a length l′ as illustrated by an imaginary line, the side piece 7 is curved without changing the length m of the other side edge as illustrated by an imaginary line but extending the one side edge to the length l′, both side edges of the back piece 6 are brought face to face with the one side edges of the side pieces to form stripes, and each stripe is seamed; consequently, two ribs 8 extending in the longitudinal direction of the finger are formed on the surface of the back member 2. The back member 2 thus assembled through repetition of the foregoing processing has a shape curved concavely toward a ball catching plane. Then, the other side edges of the side pieces 7 and the tip edges of the back pieces 6 of the back member 2 are seamed with the other peripheral edges of the finger pieces 5 and the palm piece 4 of the core covering surface member 1; consequently, a covering body with the core covering surface member 1 arranged on the surface side is formed which is adapted for insertion of the hand. In the interior core covering C of the first embodiment shown in FIG. 1, every fingerstall 9 . . . of the back member 2 is made by one back piece 6 and two side pieces 7,7 and has an effect of curvature, and as shown in FIG. 4, is kept in the state wherein it is curved concavely toward the ball catching face. It should be noted in FIG. 1 that 11 designates eyelets adapted for running of a strap.

Although in the foregoing interior core covering C the back piece 6 substantially equal in length to the side piece 7 is extended such that the back piece 6 becomes longer than the side piece 7, where no effect of curvature is expected for the fingerstall 9, the back piece 6 and the side pieces 7 arranged so as to cover the finger piece 5 from root to tip may be made substantially equal in length and seamed together without changing the length. Further, where no effect of curvature is required for a thumbstall 10 and a little fingerstall 12 as a modification of the interior core covering C of the first embodiment, as shown in FIG. 2, each back member element 2 of the thumbstall 10 and the little fingerstall 12 may be composed of two side pieces 7,7. Further, the process of seaming both side edges of the back piece 6 and the one side edges of the side pieces 7 may be performed after the side edges of two pieces are put in face-to-face abutment or in superposed arrangement.

Figures 5, 6A, 6B:
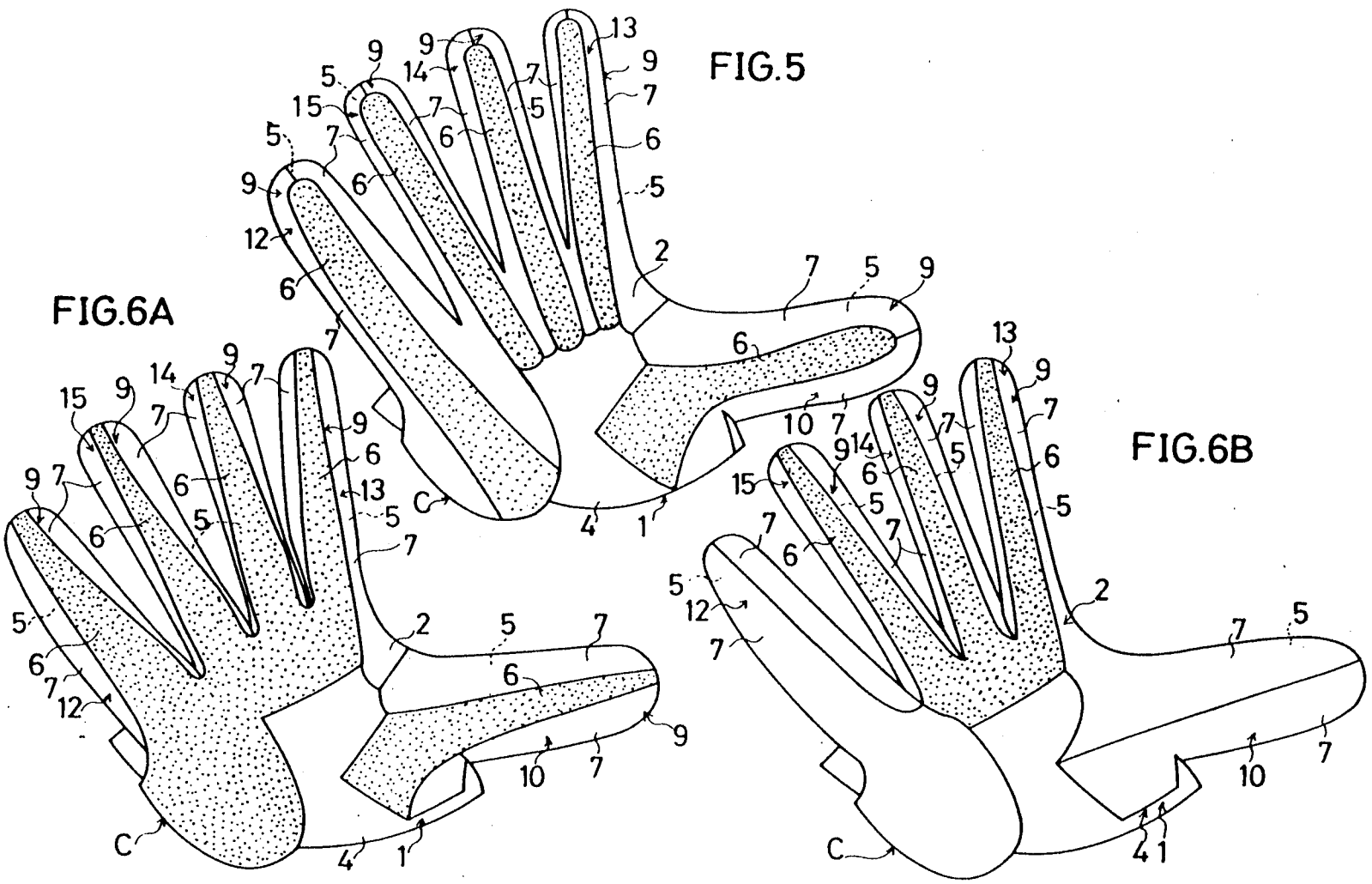
FIG. 5 is a schematic plan view of an interior core covering according to a second embodiment.

In a second embodiment of the interior core covering C, as shown in FIG. 5, adjacent root portions of the side piece 7 of an index fingerstall 13 and the side piece 7 of a middle fingerstall 14, adjacent root portions of the side piece 7 of the middle fingerstall 14 and the side piece 7 of a ring fingerstall 15, and adjacent root portions of the side piece 7 of the ring fingerstall 15 and the side piece 7 of the little fingerstall 12 of the back member 2 are individually connected integrally together on the back of the palm piece 4. The tip of the surface member 1 is made longer than the tip of the back piece 6 of the back member 2, the tips of the side pieces 7 on both sides of the back piece 6 of each fingerstall are aligned with the tip of the surface member 1, these tips are seamed together, and the core covering surface member 1 is seamed with the back member 2 as is the case of the first embodiment to form the covering body.

In a third embodiment of the interior core covering C, as shown in FIG. 6 A, respective root portions of the back pieces 6 for the fingers except the thumb are connected integrally together on the back of the palm piece 4. The covering body is formed by seaming the core covering surface member 1 and the back member 2 together as is the case of the first embodiment. As an example of the third embodiment, where no effect of curvature is required for the thumbstall 10 and the little fingerstall 12, as shown in FIG. 6 B, each back member element 2 of the thumbstall 10 and the little fingerstall 12 may be composed of two side pieces 7,7.

In a fourth embodiment of the interior core covering C, as shown in FIG. 7, the tip of the surface member 1 is made longer than the tips of the back piece 6 and side pieces 7 of the back member 2. The tips of the back piece 6 and side pieces 7 are seamed together with the finger piece 5 of the core covering surface member 1, and the core covering surface member 1 and the back member 2 are seamed together as is the case of the first embodiment to form the covering body.

On the other hand, as shown in FIG. 1, the exterior covering B has a covering body structure in which the foregoing interior core covering C can be inserted. Side pieces 17 are arranged on both sides of a back piece 16 which is smaller in width than the finger back and capable of covering the finger back and up to a central portion of the palm back, both side edges of the back piece 16 and one side edge of the side pieces 17 are folded inward, and these edges are seamed together with strip members 18 interposed between them; consequently, two parallel seam lines 18' are formed on the finger back. Here, of course, the back piece 16 is made longer than the side piece 17 as is the case of the interior core covering C. It should be noted in FIG. 1 that 19 designates eyelets for running of a strap.

As will be appreciated, the baseball glove A can be assembled by inserting the interior core covering C curved concavely toward the ball catching face in the exterior covering B also curved concavely toward the ball catching face, attaching the connecting member D, and running a strap not shown through the eyelets 11 . . . , 19 . . . bored in the individual members.

Since the fingerstalls 9 . . . , 20 . . . of the interior core covering C and the exterior covering B are curved concavely toward the ball catching face, the baseball glove A thus assembled can maintain the state of the fingerstalls curved concavely toward the ball catching face, thus makes it easy to catch the ball not only in an initial stage of use but also after a long period of use.

In the interior core covering C according to the first embodiment of the present invention, (1) the back piece 6 and the side pieces 7 arranged so as to cover the finger piece 5 from root to tip are dimensioned such that the back piece 6 is longer, and due to the reinforcement power of the two ribs 8 formed on the surface of the back member 2, the fingerstalls 9 of the interior core covering C are kept in the state wherein they are curved concavely toward the ball catching face; thus, the fingerstalls 9 of the baseball glove A formed by inserting the interior core covering C in the exterior covering B are still curved concavely toward the ball catching face, this making it easy and sure to catch the ball not only in an initial stage of use but also after a long period of use; (2) each fingerstall of the core covering surface member 1 and of the back member 2 is formed by the back piece 6 and the two side pieces 7 arranged on both sides thereof, and both side edges of the back piece 6 and the one side edges of the side pieces 7 are individually put in face-to-face abutment and seamed together to form the two ribs 8 on the surface of the back member 2 in the longitudinal direction of the finger, thereby leaving a space inside the fingerstall 9; thus, the baseball glove A formed by inserting the interior core covering C in the exterior covering B facilitates insertion of the hand and imposes no sense of oppression on the fingers in use; and (3) the back piece 6 of the back member 2 is dimensioned such that its width increases progressively from tip to root like an unfolded fan, thereby making larger the opening at the root of the fingerstall 9 of the interior core covering C; thus, the baseball glove A formed by inserting the interior core covering C in the exterior covering B facilitates insertion of the hand in use.

In the interior core covering C according to the second embodiment, adjacent root portions of the side pieces 7 are connected integrally together on the back of the palm piece 4; thus, several seam portions can be omitted, making manufacture easy, in addition to the effects of the interior core covering C according to the first embodiment.

In the interior core covering C according to the third embodiment, root portions of the back pieces 6 for the fingers except the thumb are connected integrally together on the palm back; thus, the back of the hand cannot touch the seamed portions, there arises no feeling of physical disorder in use, and several seam portions can be omitted, making manufacture easy, in addition to the effects of the interior core covering C according to the first embodiment.

In the interior core covering C according to the fourth embodiment, the tips of the back piece 6 and side pieces 7 of the back member 2 are made longer than the tip of the surface member 1; thus, a material which forms tip portions of the back piece 6 and side pieces 7 of the back member 2 and a seaming process therefor can be omitted, making manufacture easy, in addition to the effects of the interior core covering C according to the first embodiment.

Further, in the baseball glove A according to the embodiments of the present invention, the fingerstalls 9 . . . , 20 . . . of the interior core covering C and the exterior covering B are curved concavely toward the ball catching face; thus, the fingerstalls of the glove A are also largely curved concavely toward the ball catching face, this making it easy and sure to catch the ball not only in an initial stage of use but also after a long period of use. In addition, when the glove A is put on, the finger is seated between the two parallel seam lines 18′ on the finger back 16 of external covering B via the back piece 6 of the interior core covering C, not coming to contact with the seam lines 18′; thus, there arises no feeling of physical disorder during use, and the ball can be surely caught.

The present invention is configured as described above and provides the following effects.

In the interior core covering of the baseball glove, each fingerstall is formed by the back piece and the side pieces arranged on both sides thereof of the core covering surface member and those of the back member, leaving a large space inside the fingerstall; thus, the baseball glove formed by inserting the interior core covering in the exterior covering facilitates insertion of each finger and imposes no sense of oppression on each finger in use. Further, when the glove is put on, the back of each finger comes to contact with the corresponding back piece of the interior core covering, not with the seamed portions of the back piece and side pieces; thus, there arises no feeling of physical disorder, whereby the ball can be surely caught.

In the interior core covering of the baseball glove, since the back piece and the side pieces arranged so as to cover the finger piece from root to tip are dimensioned such that the back piece is longer, each fingerstall is kept in the state wherein it is curved concavely toward the ball catching face; thus, each fingerstall of the baseball glove formed by inserting the interior core covering in the exterior covering is also curved concavely toward the ball catching face; accordingly, the ball can be caught readily and surely not only in an initial stage of use but also after a long period of use.

In the interior core covering of the baseball glove, each pair of ribs on the surface of the back member serves as reinforcing means to surely retain the inner space of each fingerstall of the interior core covering, thereby enhancing the effect of curvature of the fingerstall; thus the baseball glove formed by inserting the interior core covering in the exterior covering facilitates insertion of the hand into the interior core covering and imposes no sense of oppression on the fingers in use. Further, the width of the back piece increases progressively from tip to root like an unfolded fan so that the root edge of each fingerstall of the interior core covering can open large; thus, the effect of curvature of the fingerstall is enhanced, and the baseball glove formed by inserting the interior core covering in the exterior covering more facilitates insertion of the hand.

In the interior core covering of the baseball glove, root edge portions of the adjacent side pieces of the back member need no seaming, thereby simplifying manufacture.

In the baseball glove, each finger is seated between the two parallel seam lines on the finger back of the exterior covering via the back piece of the interior core covering, not coming to contact with these seam lines; thus, there arises no feeling of physical disorder, whereby the ball can be surely caught.

In the baseball glove, the back piece and the side pieces of the interior core covering and of the exterior covering are dimensioned such that the back piece is longer; thus, each fingerstall of the interior core covering and of the exterior covering is kept in the state wherein it is curved concavely toward the ball catching face; accordingly, each fingerstall of the baseball glove is more curved concavely toward the ball catching face, whereby the ball can be readily and surely caught not only in an initial stage of use but also after a long period of use.

What is claimed is:

1. An interior core covering of a baseball glove comprising:

a core covering surface member having a palm piece and five finger pieces extending from an upper edge of the palm piece;

a back member consisting of back pieces smaller in width than the finger pieces arranged to extend from tip portions of corresponding finger pieces to a central back portion of said palm piece, and side pieces substantially equal in length to respective back pieces arranged at each side of corresponding back pieces;

said back pieces being formed such that the width of each back piece increases progressively from a tip portion to a root portion;

said back member being formed by seams connecting a first side edge of respective side pieces to said back pieces such that edges of said pieces form a pair of outwardly extending ribs on an external surface of each back piece of said back member in a longitudinal direction of the finger; and a second edge of each side piece being seamed with a peripheral edge of a corresponding finger piece of said core covering surface member whereby a covering body adapted for insertion of a hand is formed by the core covering surface member and the back member.

2. An interior core covering of a baseball glove as recited in claim 1, wherein each of said back pieces is longer in length than its corresponding side pieces so as to form finger stalls which are curved concavely toward a ball catching face of said baseball glove.

3. An interior core covering of a baseball glove according to claim 1 or 2, wherein finger root portions of the back pieces for fingers other than the thumb and little finger are connected integrally together.

4. An interior core covering of a baseball glove according to claim 1 or 2, wherein finger root portions of the back pieces for fingers other than the thumb and little finger are connected integrally together.

5. A baseball glove formed by an exterior covering and an interior core covering accommodated therewithin, comprising:

an interior core covering including a core covering surface member and a back member, said core covering surface member having a palm piece and five finger pieces extending from an upper edge of the palm piece; said back member consisting of back pieces smaller in width than said finger pieces arranged to extend from tip portions of corresponding finger pieces to a central back portion of said palm piece, and side pieces arranged at each side of corresponding back pieces, wherein said back pieces are formed to increase in width progressively from a tip portion to a root portion, and said back member is formed by said back pieces and side pieces being connected at edges which form a pair of outwardly extending ribs on an external surface of each back piece in a longitudinal direction of the finger; other edges of each side piece being connected with a peripheral edge of a corresponding finger piece of said core covering surface member to join said back member thereto whereby a covering body adapted for insertion of a hand is formed; and an exterior covering having a covering body including a ball catching palm face having fingers extending therefrom, and a back member seamed to said palm face to form finger stalls to accommodate fingers of said interior core covering, each finger stall being formed by a back piece smaller in width than its respective palm face finger arranged so as to cover the finger to a central portion of the palm face, and side pieces connecting each finger to a respective back piece at each side thereof to form two parallel seam lines;

said baseball glove being composed of said exterior covering with said interior core covering accommodated therewithin and connected thereto by a connecting member.

6. A baseball glove according to claim 5, wherein each back piece of said interior core covering is longer in length than its corresponding side pieces so as to form finger stalls of said interior core covering curved concavely toward the ball catching face of said exterior covering body; and each back piece of said exterior covering is longer in length than its corresponding side pieces so as to form finger stalls of said exterior covering curved concavely toward the ball catching face.

7. A baseball glove according to claim 5 or 6 wherein finger root portions of back pieces for fingers of said interior core covering other than the thumb are connected integrally together.

8. A baseball glove according to claim 5 or 6 wherein finger root portions of back pieces for fingers of said interior core covering other than the thumb and little finger are connected integrally together.

9. A baseball glove formed by an exterior covering and an interior core covering accommodated therewithin, comprising:

an interior core covering including a core covering surface member and a back member, said core covering surface member having a palm piece and five finger pieces extending from an upper edge of the palm piece; said back member consisting of back pieces smaller in width than said finger pieces arranged to extend from tip portions of corresponding finger pieces to a central back portion of said palm piece, and side pieces arranged at each side of corresponding back pieces, wherein said back pieces are formed to increase in width progressively from a tip portion to a root portion, and said back member is formed by said back pieces and side pieces being connected at edges which form a pair of outwardly extending ribs on an external surface of each back piece in a longitudinal direction of the finger; other edges of each side piece being connected with a peripheral edge of a corresponding finger piece of said core covering surface member to join said back member thereto whereby a covering body adapted for insertion of a hand is formed; and an exterior covering having a covering body including a ball catching palm face having fingers extending therefrom, and a back member seamed to said palm face to form finger stalls to accommodate fingers of said interior core covering;

said baseball glove being composed of said exterior covering with said interior core covering accommodated therewithin and connected thereto by a connecting member.

10. A baseball glove according to claim 9, wherein each back piece of said interior core covering is longer in length than its corresponding side pieces so as to form finger stalls of said interior core covering curved concavely toward the ball catching face of said exterior covering body.

11. A baseball glove according to claim 9 or 10 wherein finger root portions of back pieces for fingers of said interior core covering other than the thumb are connected integrally together.

12. A baseball glove according to claim 9 or 10 wherein finger root portions of back pieces for fingers of said interior core covering other than the thumb and little finger are connected integrally together.

* * * * *